US005850918A

United States Patent [19]

Pienta

[11] Patent Number: 5,850,918

[45] Date of Patent: Dec. 22, 1998

[54] ROLL PACKAGE AND METHOD OF MAKING

[75] Inventor: David J. Pienta, Lambertville, Mich.

[73] Assignee: Automatic Handling, Inc., Erie, Mich.

[21] Appl. No.: 878,736

[22] Filed: Jun. 19, 1997

[51] Int. Cl.[6] ..... B65B 11/00; B65D 85/671

[52] U.S. Cl. ..... 206/410; 53/399

[58] Field of Search ..... 53/399, 419, 441, 53/449, 461; 206/389, 407, 410, 413

[56] References Cited

U.S. PATENT DOCUMENTS

| | | | |
|---|---|---|---|
| 2,067,111 | 1/1937 | Aberle | 206/410 |
| 2,250,875 | 7/1941 | McConnell | 206/410 |
| 3,895,711 | 7/1975 | Hiltunen et al. | 206/413 |
| 4,235,062 | 11/1980 | Lancaster, III et al. | 53/399 |
| 4,736,567 | 4/1988 | Pienta . | |
| 4,746,011 | 5/1988 | McNair, Jr. et al. | 53/399 |
| 4,886,167 | 12/1989 | Dearwater | 206/389 |
| 5,046,298 | 9/1991 | Norkowski et al. . | |
| 5,131,209 | 7/1992 | Schreiber et al. . | |
| 5,487,255 | 1/1996 | Soderberg | 53/399 |

FOREIGN PATENT DOCUMENTS

| | | |
|---|---|---|
| 41 37 448 A | 5/1993 | Germany . |
| WO 92 17371 A | 10/1992 | WIPO . |

OTHER PUBLICATIONS

Drautzburg R: "Neue Verpackungstechnologie in der Coilverpackung" Stahl und Eisen, vol. 112, No. 7, 15 Jul. 1992, pp. 47–48, XP000293325.

*Primary Examiner*—Jim Foster

*Attorney, Agent, or Firm*—Emch, Schaffer, Schaub & Porcello, Co., L.P.A.

[57] ABSTRACT

The invention is a roll package and the method of making the package. A body to be enclosed has a longitudinal axis. A first layer of material is axially wrapped on the body with the first layer extending generally parallel to the longitudinal axis. A second and a third layer are than radially wrapped over the first layer in a direction generally perpendicular to the longitudinal axis. The second layer is a protective cushion layer which extends adjacent the ends of the body and extends inwardly to protect the edges of the body being enclosed.

24 Claims, 4 Drawing Sheets

ROLL PACKAGE AND METHOD OF MAKING

BACKGROUND OF THE INVENTION

Roll packages and wrapping machines for making roll packages are well known in the art. A wrapping machine which includes means for wrapping radial layers of materials in an interleaved manner are shown in my prior U.S. Pat. No. 4,736,567 which was granted Apr. 12, 1988.

Another prior art wrapping machine is disclosed in my U.S. Pat. No. 4,882,892 issued Nov. 28, 1989. This prior art wrapping machine is a dual station wrapping machine where successive layers of material are positioned on a roll or body to be wrapped.

Bodies to be wrapped by an improved package include paper rolls, such as carbonless paper rolls which are very sensitive to marking. Another type of body to be wrapped is a material roll, for example, a roll of plastic film material which is to be utilized to cover foods in the food industry. The roll package for this type of a body must form a roll package which does not contaminant the film layers being wrapped.

SUMMARY OF THE INVENTION

The present invention is directed to an improved roll package and the method of making the improved roll package. The improved roll package is particularly adaptable for use in situations where the roll body, which is being wrapped, must be protected from contamination or edge damage. While the body being wrapped may have a shape other than a cylindrical shape, the present roll package and method of making, normally applies multiple layers to a generally cylindrical roll body which has a longitudinal central axis and a pair of spaced ends. The body to be wrapped also includes an outer surface which extends between the ends and is radially spaced from the longitudinal axis.

The roll package includes an inner first layer, for example, a plastic film layer, which extends over the outer surface of the body and is wrapped on the outer surface in a direction generally parallel to the longitudinal axis of the body. The first layer also extends over the spaced ends.

A second layer is positioned over the first layer. The second layer is wrapped over the outer surface adjacent to the spaced ends of the body in a direction generally perpendicular to the longitudinal axis by using a radial wrap. The second layer is a protective layer, normally a cushion layer, such as a foamed plastic layer or a plastic bubble wrap layer.

A third layer is positioned over the outer surface of the body by using a radial wrap which is perpendicular to the axis of the body.

In one embodiment, the second and third layers are interleaved with one another. In another embodiment, the second and third layers are successively wrapped.

In some embodiments, end protection, such as protective end disc is applied adjacent each end of the body.

DESCRIPTION OF THE PREFERRED EMBODIMENTS

Figure 3:
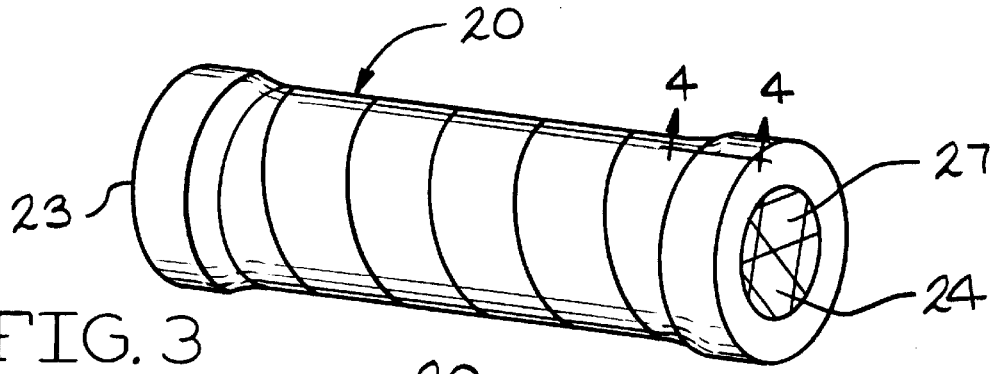
FIG. 3 is a perspective view, similar to FIG. 1, showing the roll package, according to the present invention after the second and third layers of wrapping material have been applied.

Referring to FIG. 3, a roll package, according to the present invention is generally indicated by the reference number 20. While the roll package 20 may be used to wrap articles of different shapes and configurations, it is particularly useful in wrapping cylindrical articles or bodies. These cylindrical articles are, for example, rolls of material, including rolls of surface sensitive papers and films or rolls of films which are to be used in wrapping food stuffs. In those types of items, improper packaging results in marking the sensitive layers in the first instance and possibly contaminating the food materials in the second instance.

Figure 1:
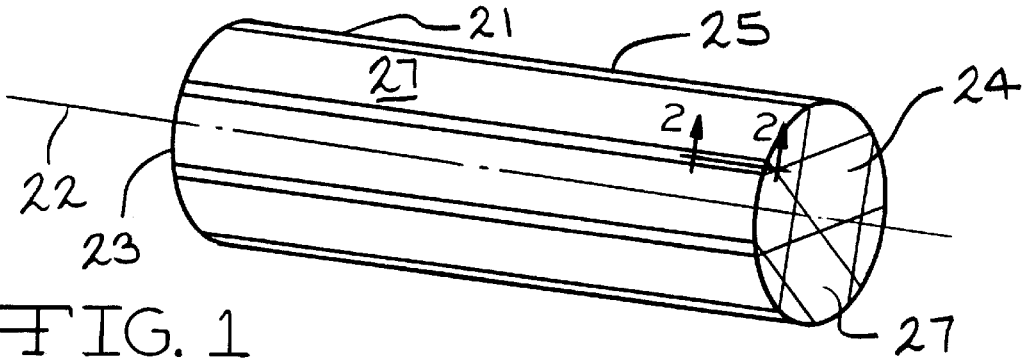
FIG. 1 is a perspective view of a roll package, according to the present invention, after the first layer of wrapping material has been applied to the body.
Figure 2:
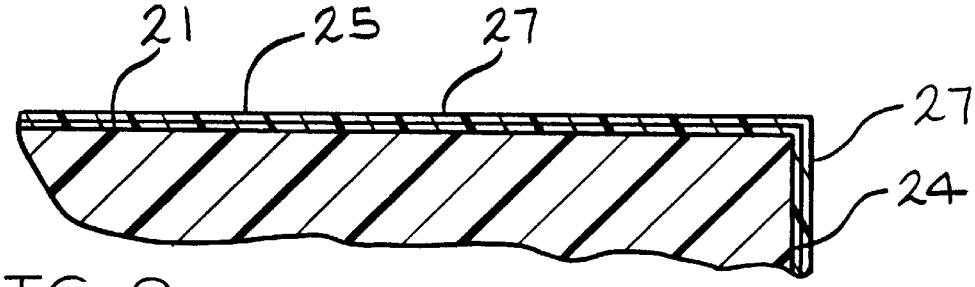
FIG. 2 is a fragmentary, enlarged cross-sectional view taken along the line 2—2 of FIG. 1.

Referring to FIG. 1, the roll package 20 is used to cover a longitudinally extending cylindrical body 21. The cylindrical body 21 has a longitudinal center axis 22, a pair of spaced ends 23 and 24 and a cylindrically shaped outer surface 25 extending between the ends 23 and 24.

The roll package 20 includes an inner first layer 27 which extends over the outer surface 25 in a direction generally parallel to the longitudinal axis 22. The first layer 27 also extends around the spaced ends 23 and 24, as shown in FIG. 1. The first layer 27 is preferably a plastic stretch film normally having a thickness between 60 gauge and 300 gauge. The plastic film is normally a polyethylene film.

Figure 9:
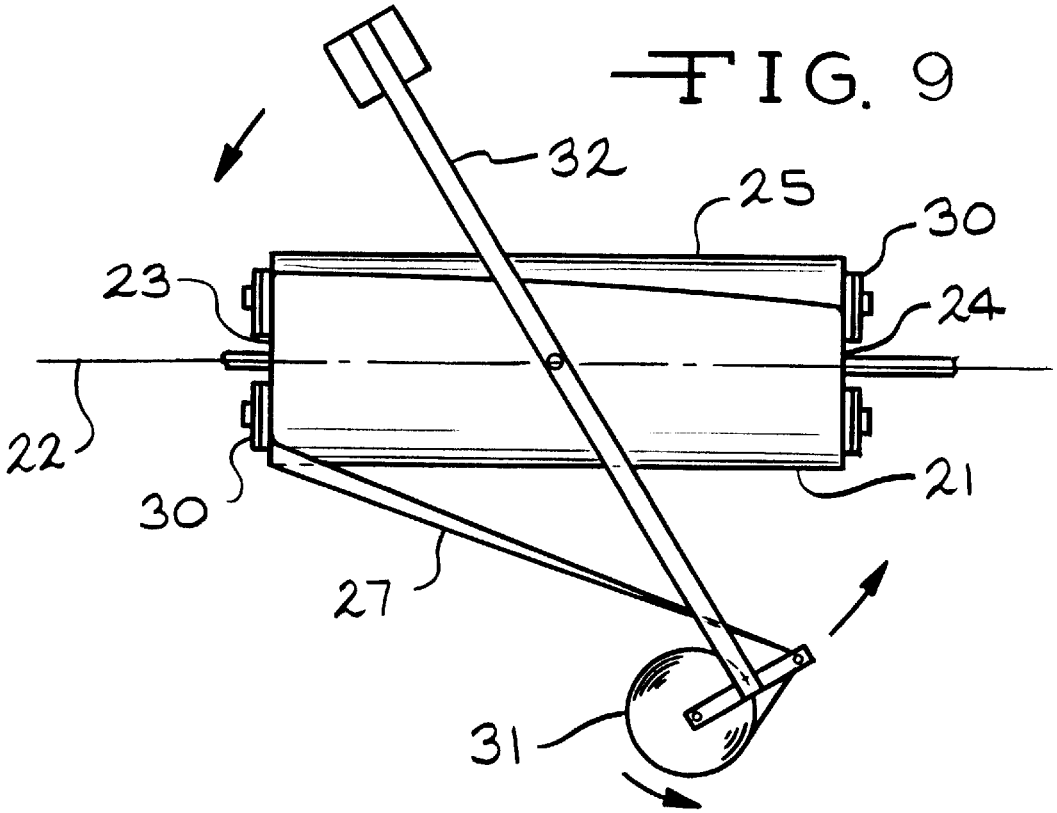
FIG. 9 is a diagrammatic view showing a method of making the roll package, according to the present invention, and showing in particular the application of the first layer to the body being wrapped.
Figure 10:
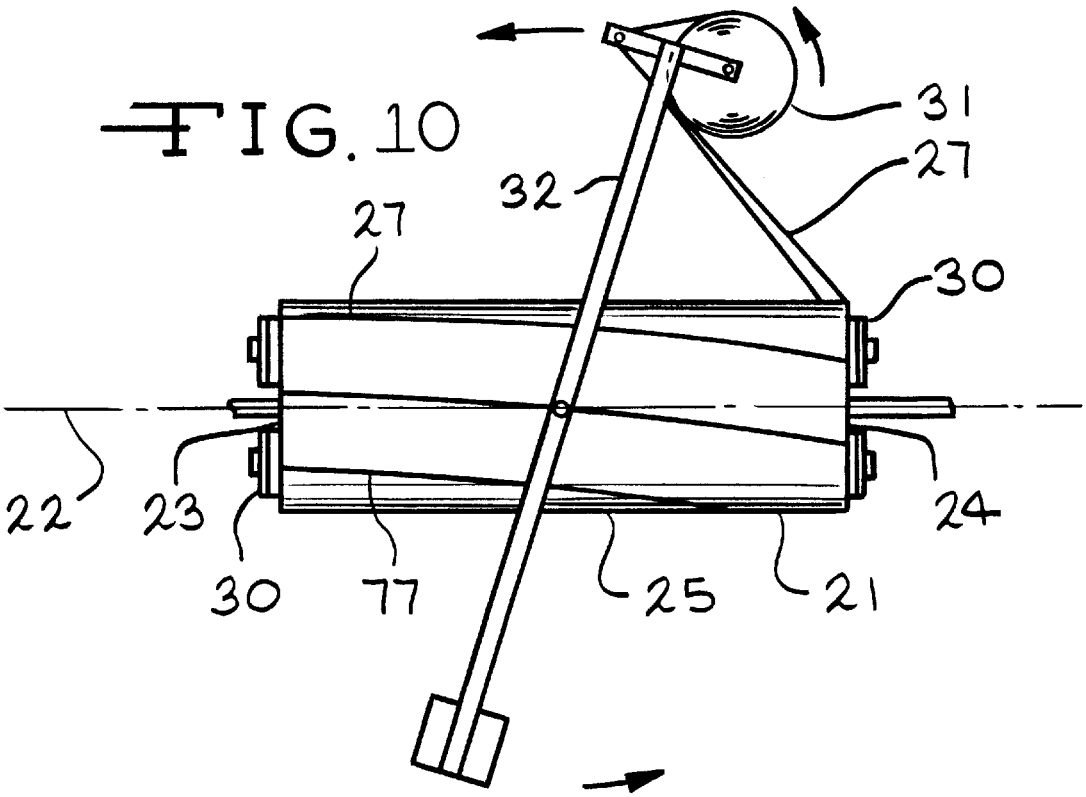
FIG. 10 is a view similar to FIG. 9, showing further wraps of the first layer being applied to the body.

FIGS. 9–13 disclose a diagrammatic machine and method for making the roll package 20. Initially, the cylindrical body 21, which is the article to be wrapped, is positioned on rollers 30. The first layer 27 is dispensed from a roll 31. In the present embodiment, the roll 31 is rotated to apply the first layer 27 to the cylindrical body 21 such that the first layer 27 is positioned on the outer surface 25 in a direction generally parallel to the longitudinal axis 22. As shown in FIG. 9 and FIG. 10, multiple thicknesses of the first layer 27 are applied over the outer surface 25 and the ends 23 and 24 of the body 21 as the roll 31 is rotated around the body 21 by an arm 32.

The roll package 20 also includes a second layer 35 and a third layer 36. The second layer 35 and the third layer 36 are positioned over the first layer 27 on the body 21. While the first layer 27 is applied axially in a direction generally parallel to the longitudinal axis 22 of the body 21, the second layer 35 and the third layer 36 are applied radially over the outer surface 25 and the first layer 27 in a direction generally perpendicular to the longitudinal axis 22. The second layer 35 is preferably a protective cushion layer. The preferred materials for the second layer 35 include a foamed plastic cushioning material, a layer of plastic cushion bubble pack material or an extruded plastic material. The thickness of the second layer ranges between one mil and ⅜ inch. The foam material and the bubble pack material are typically ¼ inch thick. If a Kraft paper is used for the second layer it is normally thin and used only for product identification.

Figure 11:
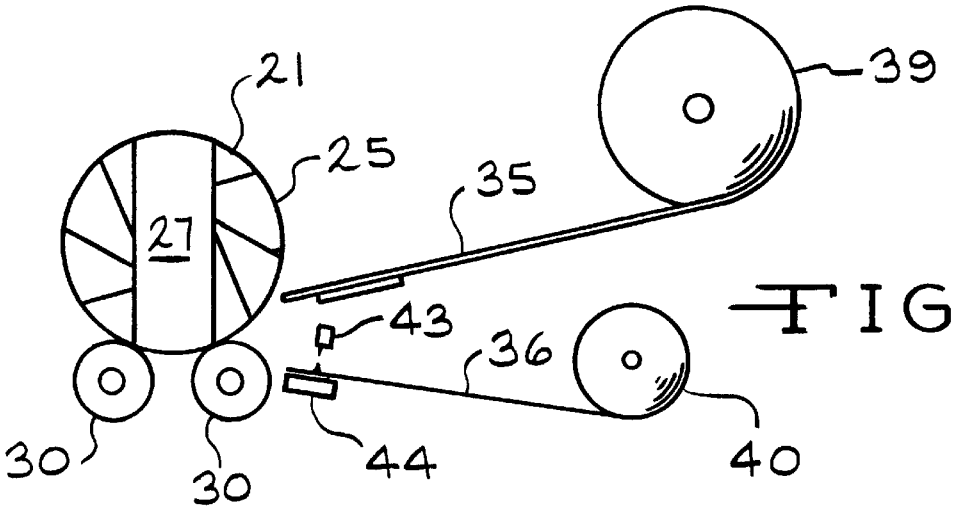
FIG. 11 is a diagrammatic view, showing the second and third layers of material prior to application to the body being wrapped.
Figure 12:
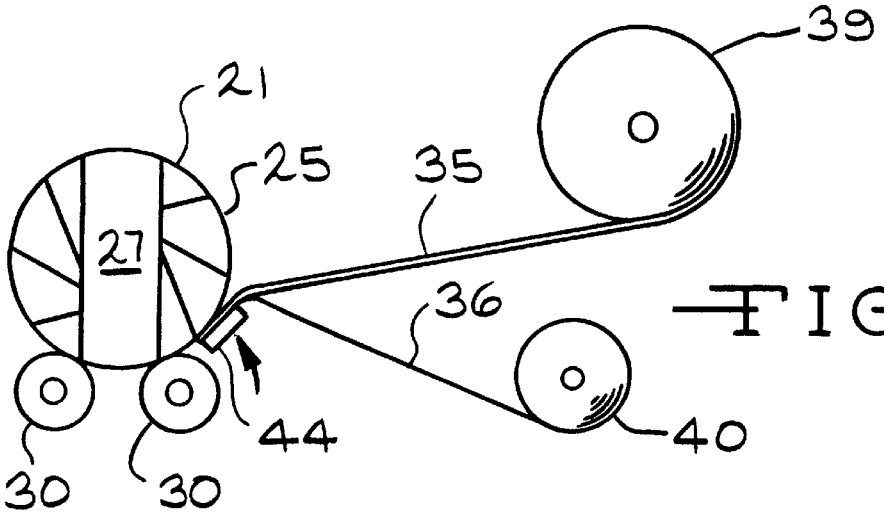
FIG. 12 is a view similar to FIG. 11, showing the second and third layers during their initial application to the body.
Figure 13:
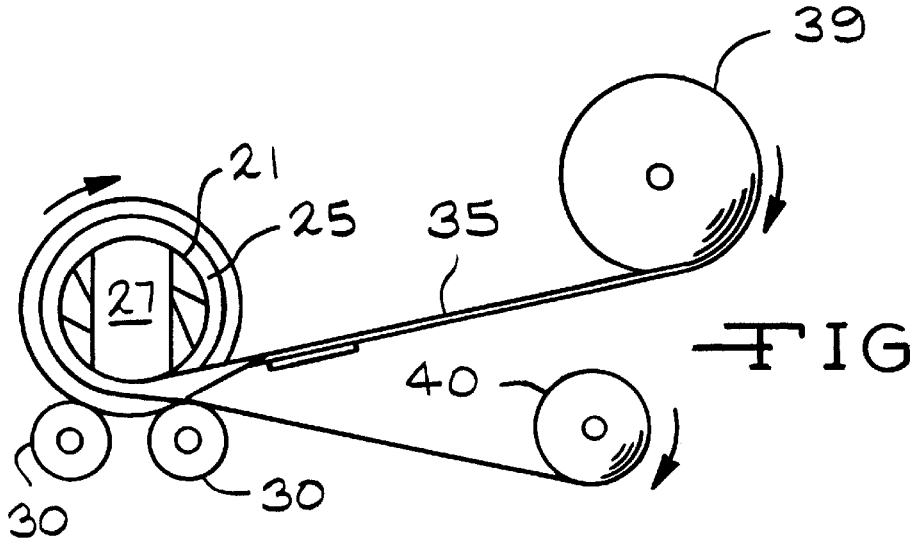
FIG. 13 is a view similar to FIG. 12 showing the second and third layers being radially wrapped on the body over the first layer.

Referring to FIGS. 11–13, a roll 39 dispenses the second layer 35 and a roll 40 dispenses the third layer 36. In the present embodiment, the second layer 35 is a plastic foam layer while the third layer 36 is a plastic stretch film such as a polyethylene film having a thickness between 60 gauge and 300 gauge.

Referring to FIG. 11, an adhesive dispenser 43 dispenses an adhesive on the end of the third layer 36. In this embodiment, the end of the second layer 35 is interleaved with the third layer 36 and a platen 44 is rotated upwardly against the outer surface 25 to initially adhere or connect the second and third layers 35 and 36 to the outer surface 25. By enclosing the body 21 in the wrap formed by the first layer 27, possible contamination by the adhesive is eliminated because the adhesive does not contact the body 21. The cylindrical body 21 is then rotated, as shown in FIG. 13, and the interleaved second layer 35 and third layer 36 are applied in a radial or direction generally perpendicular to the longitudinal axis 22. As the second layer 35 and third layer 36 are applied to the outer surface 25, it is also in a direction generally perpendicular to the major direction of the first layer 27.

Figure 4:
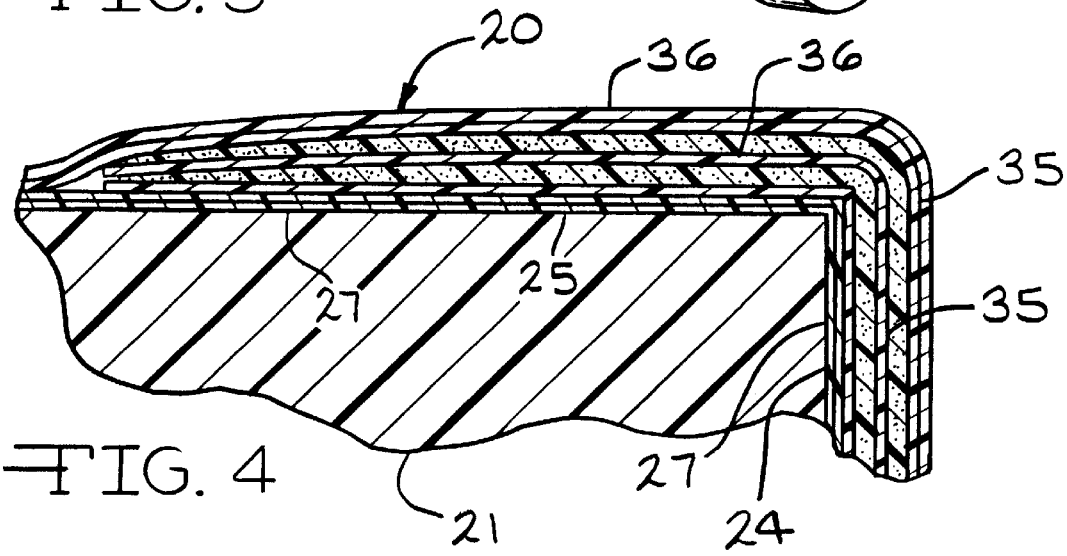
FIG. 4 is a fragmentary enlarged cross-sectional view taken along the line 4—4 of FIG. 3.

In the embodiment shown in FIGS. 3 and 4, a wrap of the third layer 36 forms the outer surface of the roll package 20. In another embodiment, not shown, the second layer 35 may include a layer of Kraft paper, which may be used for product identification and is viewable under an outer wrap of the third layer 36.

As shown in FIGS. 3 and 4, the second layer 35 and third layer 36 are positioned adjacent the ends 23 and 24 of the body 21 where they extend downwardly over the ends 23 and 24 to protect the ends 23 and 24 from damage. This type of edge protection is very important when the body 21 is formed of sensitive or damage prone materials. In the FIGS. 3 and 4 embodiment, the second layer 35 includes separate portions applied on the outer surface 25 adjacent the opposed ends 23 and 24. In this embodiment the second layer 35 does not extend throughout the length of the roll package 20.

Figure 7:
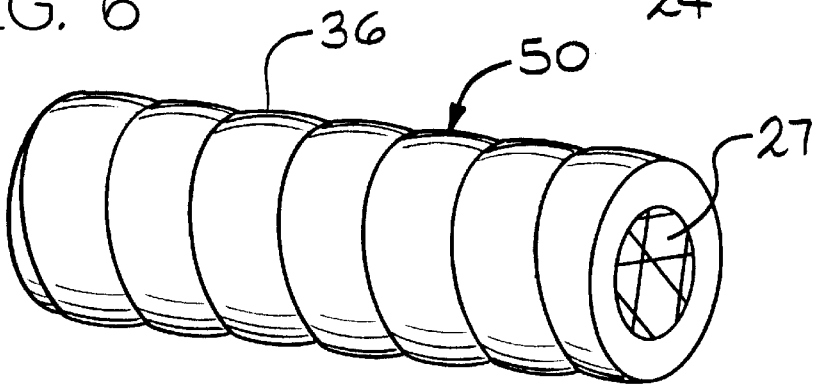
FIG. 7 is a perspective view similar to FIG. 5, showing another embodiment of a roll package, according to the present invention.

Another embodiment of a roll package, according to the present invention, is generally indicated in FIG. 7 by the reference number 50. In the roll package 50, the structure is similar to the structure of the roll package 20, shown in FIGS. 3 and 4 with the exception that the second layer 35 extends throughout the length of the roll package 20 covering the entire outer surface 25 of the cylindrical body 21. In addition, in the roll package 50, the second layer 35 and third layer 36 are not interleaved, but rather, the layers are successive layers. The second layer 35 is positioned over the first layer 27. Finally the third layer 36 is positioned over the second protective layer 35. The third layer 36 forms the outer wrap of the overall roll package 50.

Figure 5:
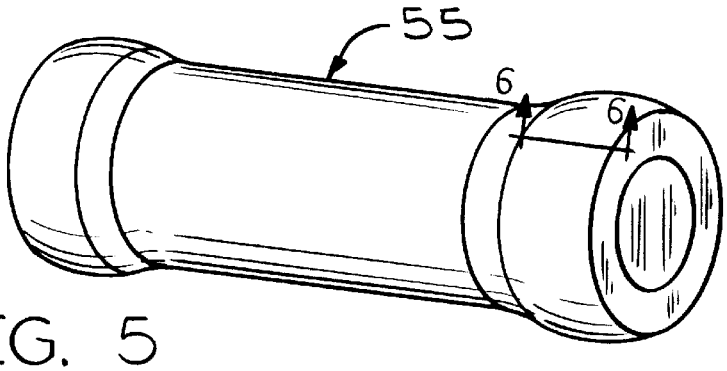
FIG. 5 is a view, similar to FIG. 3, showing another embodiment of a roll package according to the present invention.
Figure 6:
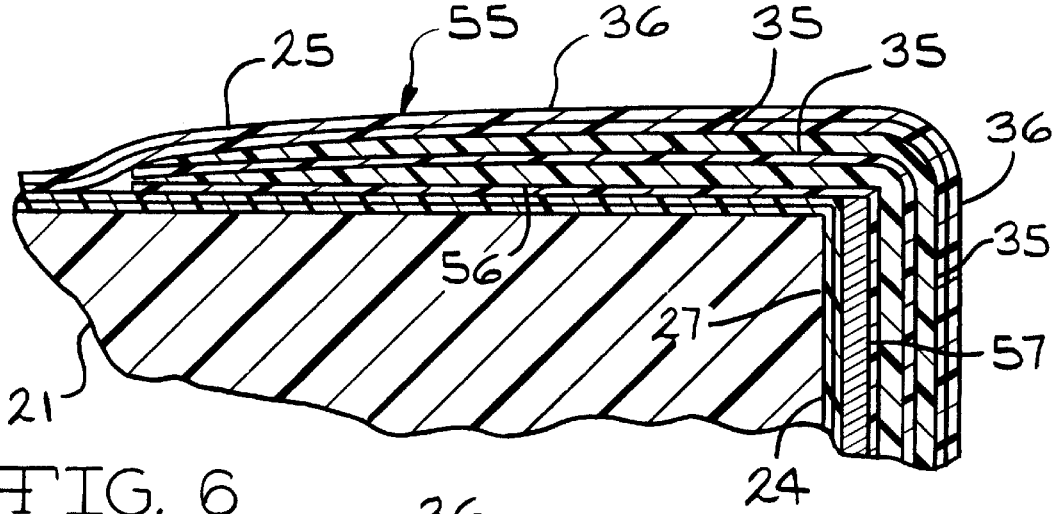
FIG. 6 is an enlarged fragmentary sectional view taken along the line 6—6 of FIG. 5.

A still further embodiment of a roll package, according to the present invention is generally indicated by the reference number 55 in FIGS. 5 and 6. In this embodiment, the second layer 35 is divided in portions 56 which are applied adjacent the ends 23 and 24 but do not extend throughout the roll package 55 across the entire outer surface 25 of the body 21. In the roll package 55 a disc, such as a cardboard protective disc 57, is applied over the wrap formed by the first layer 27 adjacent the ends 23 and 24. The disc 57 can be, for example, a cardboard disc, well known in the art. Portions of the protective second layer 35 and the third layer 36 extend around the corners over the periphery of the protective disc 57, as shown in FIG. 6.

Figure 8:
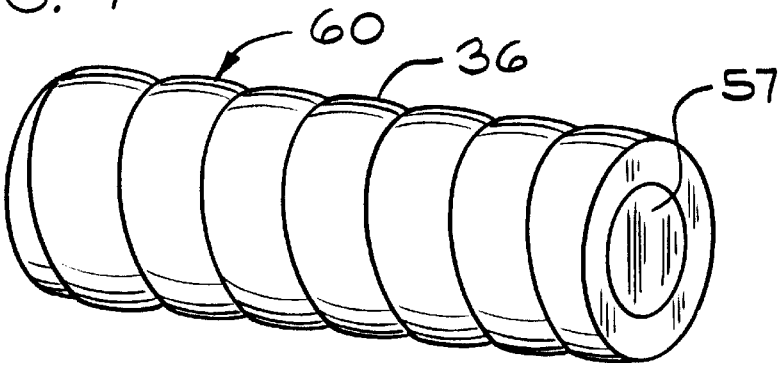
FIG. 8 is a perspective view similar to FIG. 7, showing a still further embodiment of a roll package, according to the present invention.

A still further embodiment of a roll package, according to the present invention is generally indicated by the reference number 60 in FIG. 8. The roll package 60 is similar to the embodiment shown in FIG. 5 and FIG. 6 and includes the protective disc 57. However, in the FIG. 8 embodiment, the second protective layer 35 extends completely over the outer surface 25 of the cylindrical body 21 with a wrap of the third layer 36 forming the outer surface of the roll package 60.

Numerous modifications may be made to the preferred embodiments of the roll package and method of making the roll package described above without departing from the scope of the present invention or from the following claims.

I claim:

1. A package for a roll having a longitudinal axis, a pair of spaced ends and an outer surface extending between the ends and radially spaced from said axis, said package comprising an inner first layer extending over said outer surface of said roll and wrapped on said outer surface in a direction generally parallel to said longitudinal axis, said first layer extending over said spaced ends, a separate second layer positioned over said first layer, said second layer being a cushioned protective layer, said second layer positioned over the outer surface of said first layer adjacent each of said spaced ends in a direction generally perpendicular to said longitudinal axis, and a separate third layer positioned on the outer surface of said package in a direction generally perpendicular to said longitudinal axis, said third layer having a portion forming the outermost surface of said package.

2. A package, according to claim 1, wherein said second layer and said third layer are at least partially interleaved.

3. A package, according to claim 1, wherein said second layer is a foam layer.

4. A package, according to claim 1, wherein said second layer is a bubble pack layer.

5. A package, according to claim 1, wherein said first layer is a plastic film.

6. A package, according to claim 1, wherein said third layer is a plastic film.

7. A package, according to claim 1, wherein said second layer includes separate portions applied on said outer surface adjacent said opposed ends, said portions of said second layer extending inwardly over a portion of each of said spaced ends.

8. A package, according to claim 7, wherein said third layer extends throughout the length of said cylindrical body and covers said portions of said second layer.

9. A package, according to claim 1, wherein said second layer extends throughout the length of said cylindrical body.

10. A package, according to claim 1, including a protective end disc positioned on each of said spaced ends.

11. A method of making a package for a roll of material having a longitudinal axis, a pair of spaced ends and an outer surface extending between the ends, said package including first, second and third separate layers, said second layer being a separate protective cushion layer, including the steps of:

axially wrapping said roll with the first layer wherein the first layer is applied on the outer surface in a direction generally parallel to such longitudinal axis; and radially wrapping said roll with the second and third layers wherein said second and third layers are applied on the outer surface in a direction generally perpendicular to such longitudinal axis.

12. A method, according to claim 11, wherein said second and third layers are interleaved as they are applied.

13. A method, according to claim 11, wherein said second and third layers are successively applied.

14. A method, according to claim 11, wherein said second layer is a cushioned protective layer extending throughout the length of said cylindrical body.

15. A method, according to claim 11, wherein said second layer is a cushioned protective layer including separate portions applied adjacent said spaced ends of said roll package.

16. A package for a roll having a longitudinal axis, a pair of spaced ends and an outer surface extending between the ends and radially spaced from said axis, said package comprising an inner first layer extending over said roll outer surface and wrapped on said outer surface in a direction generally parallel to said longitudinal axis, said first layer extending over said spaced ends, a second layer positioned over said first layer, said second layer positioned over the outer surface of said first layer adjacent each of said spaced ends in a direction generally perpendicular to said longitudinal axis, said second layer being a foam layer, and a third layer positioned on the outer surface of said second layer in a direction generally perpendicular to said longitudinal axis, said third layer having a portion forming the outermost surface of said package.

17. A package for a roll having a longitudinal axis, a pair of spaced ends and an outer surface extending between the ends and radially spaced from said axis, said package comprising an inner first layer extending over said roll outer surface and wrapped on said outer surface in a direction generally parallel to said longitudinal axis, said first layer extending over said spaced ends, a second layer positioned over said first layer, said second layer positioned over the outer surface of said first layer adjacent each of said spaced ends in a direction generally perpendicular to said longitudinal axis, said second layer being a bubble pack layer, and a third layer positioned on the outer surface of said second layer in a direction generally perpendicular to said longitudinal axis, said third layer having a portion forming the outermost surface of said package.

18. A package, according to claim 16, wherein said first layer is a plastic film.

19. A package, according to claim 16, wherein said third layer is a plastic film.

20. A package, according to claim 16, wherein said second layer includes separate portions applied on said outer surface on said first layer adjacent said opposed ends, said portions of said second layer extending inwardly over a portion of each of said spaced ends.

21. A package, according to claim 17, wherein said first layer is a plastic film.

22. A package, according to claim 17, wherein said third layer is a plastic film.

23. A package, according to claim 17, wherein said second layer includes separate portions applied on said outer surface on said first layer adjacent said opposed ends, said portions of said second layer extending inwardly over a portion of each of said spaced ends.

24. A package for a roll having a longitudinal axis, a pair of spaced ends and an outer surface extending between the ends and radially spaced from said axis, said package comprising an inner first layer extending over said roll outer surface and wrapped on said outer surface in a direction generally parallel to said longitudinal axis, said first layer extending over said spaced ends, a second layer positioned over said first layer, said second layer being a cushioned protective layer, said second layer positioned over the outer surface of said first layer adjacent each of said spaced ends in a direction generally perpendicular to said longitudinal axis, said second layer including separate portions applied on the outer surface of said first layer adjacent said opposed ends, said portions of said second layer extending inwardly over a portion of each of said spaced ends, and a third layer positioned over the outer surface of said second layer in a direction generally perpendicular to said longitudinal axis, said third layer extending throughout the length of said roll and covering said portions of said second layer, said third layer having a portion forming the outermost surface of said package.

* * * * *